United States Patent [19]

Bendini

[11] 4,134,315

[45] Jan. 16, 1979

[54] LATHE FOR MAKING CONTACT LENSES

[76] Inventor: Alberto Bendini, via Vivaldi 18, Brescia, Italy

[21] Appl. No.: 793,943

[22] Filed: May 5, 1977

[30] Foreign Application Priority Data

May 5, 1976 [IT] Italy ..... 5156 A/76

[51] Int. Cl.[2] ..... B23B 3/28; B23B 5/40

[52] U.S. Cl. ..... 82/14 R; 82/12; 51/58

[58] Field of Search ..... 82/14 R, 12; 51/58

[56] References Cited

U.S. PATENT DOCUMENTS

| | | | |
|---|---|---|---|
| 3,106,857 | 10/1963 | Langenberg et al. | 82/14 R |
| 3,835,588 | 9/1974 | Whithan | 82/12 |
| 3,909,982 | 10/1975 | Schlotfeldt | 82/12 |
| 3,977,279 | 8/1976 | Hooker | 82/14 R |

*Primary Examiner*—Leonidas Vlachos

[57] ABSTRACT

A lathe for forming contact lenses in a single cut includes a support member for hingedly mounting the tool holder turret. A lever arm extends from the tool holder turret and perpendicular to the rotational axis thereof for supporting two rollers, the first of which is positioned at the free end of the lever arm and the second of which is positioned intermediate the first roller and the axis of rotation of the turret. There is also provided a circular cam having a rising profile on which the first roller rides.

4 Claims, 8 Drawing Figures

LATHE FOR MAKING CONTACT LENSES

The purpose and the behaviour of a contact lens, that is of the small concave-convex lens which floatingly sticks to the cornea, on the interposed lachrymal liquid are well known.

It is also well known the geometric formulation of a contact lens which is indicated as being normal, due to it being free from those aberrations of sphericity which are obtained by machining, compensate for the symmetric imperfections of the corneal topography or natural optical system.

Figure 1:
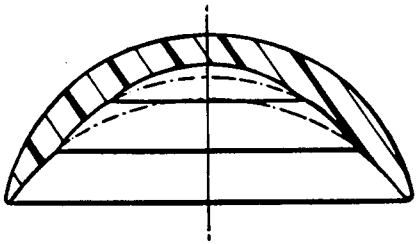

Geometrically speaking, a cross-section drawn through the optical axis of a normal corneal lens (see FIG. 1), usually shows the characteristic multispherical concave back facing the cornea, and the characteristic monospherical front surface directed away from the cornea.

There are however many cases where the convex front surface of normal corneal lenses may also require one of the two characteristics e.g. bispherical surface shown in FIG. No. 2 and FIG. No. 3, due to specific requirements of thickness and lens tolerability.

The multisphericity of the concave back is connected instead with the physiological opportunity to build up "in negative" on the lens as exactly as possible, the shape existing "in positive" on the corneal surface bearing the lens.

As a matter of fact, the topographical inspection of normal corneas shows that the corneal surface involving the corneal lens does not entirely appear as a spherical surface of constant radius, but the inspection shows that the center of the cornea is really like a spherical surface for a restricted area of 5–7 millimeters dia., while towards the iris periphery the corneal surface gradually assumes a shape more and more anaspherical, although fundamentally convex.

It is therefore understandable why by means of the usual lathes for cutting spheres it is impossible to obtain (some) revolution surfaces which progressively change from spherical to anaspherical (FIG. 8) in one single cut, that is as far as the cutting tool comes from the rotation axis of those surfaces. Besides, it is also understandable why — without suitable lathes — there is nothing to do other than to try to replace the anaspheric peripherical zone with a family of spherical surfaces, concentric but with different radii (see FIG. No. 1) of which the anaspherical corneal surface is the geometric envelope.

The more numerous are the spherical surfaces belonging to the family the nearer is the approximation to the natural requirement and the smoother and more tolerable are the circular lines of demarcation among the different concentric spherical surfaces. On the contrary, it becomes evident that the increase in manufacturing cost is due of the necessity to changing the radius and the centers of rotation of the cutting tool as many times as there are spherical surfaces to be machined for imitating, as well as possible, the anaspherical path of the cornea.

The vertical rotation axis of the turret must necessarily lie on the same plane (the plane of the drawing) that contains the horizontal rotation axis of the lens holder's spindle 4e. In a machine suitable for turning both concave and convexe spherical surface, the lens holder's spindle 4e is provided with an edge, e.g. conical, on which may be easily interchanged the tools for clamping for supporting the plastic's cylindrical blank to be faced, following either a concave or convex spherical path.

On the same above-mentioned bivalent machine, the tool 4g is supported by the turret through the rod 4f which is slidable in the horizontal plane, that is perpendicularly to the axis 4d of the turret.

When the rotation angle of the turret is equal to zero (see FIG. No. 5) the cutting edge of the tool must lie on the plane which contains both the horizontal axis of the lens holder's spindle and the vertical axis of the turret.

The horizontal stroke of the tool's rod 4f, that is the horizontal stroke of the tool itself 4g, is obtained by means of the screwed hand-wheel 4h and it is kept under control through the dial indicators 4i and 4l.

The mechanical relationship among the cutting edge of the tool 4g, the tool's rod 4f, the vertical rotation axis 4d of the turret and the dial indicators 4i and 4l is such that:

The arrows of the dial indicators are both in zero position when the tool's cutting edge lies on the axis 4d;

Only the arrow of the indicator 4i gives readings which increase when the tool's cutting edge comes over the axis 4d moving in direction of the motive head 4b;

(The arrow of the indicator 4l remains in zero position);

Only the arrow of the indicator 4l gives readings which increase when the tool's cutting edge moves back in relation to the axis 4d going in the direction of the hand-wheel 4h

(The arrow of the indicator 4i remains in zero position).

The increasing readings of the indicators 4i and 4l therefore give correct indications of the distances reached by the tool's cutting edge in relation to the rotation axis 4d of the turret, such distances being respectively equal to the concave and convex curvature radius of the spherical surfaces to be generated. Referring instead to FIG. 5 which shows from above the same machine shown in FIG. 4, it will be observed that — once set — the tool's cutting edge 5a at the wanted radial distance from the rotation axis 5d of the turret to generate a concave or convex spherical surface — the generation of one of the said surfaces is obtained by rotating first the lens holder's spindle 5e and then by pushing it out gradually — by means of the threaded hand-wheel 5c — from the motive head 5b in the direction of the tool, which is contemporarily rotated manually together with the turret around the axis 5d.

There have been several attempts in the last years to cut on the lathe uninterruptedly the above mentioned successions of spherical and anaspherical curves exemplified in FIG. No. 8, but it seems as no builder of tool machines has put up to now on the market industrial solutions of the problem.

Figure 2:
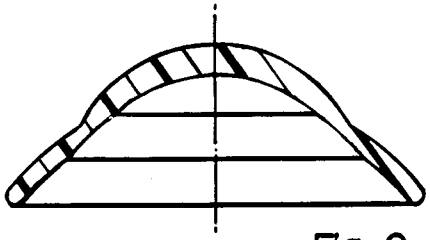
Figure 3:
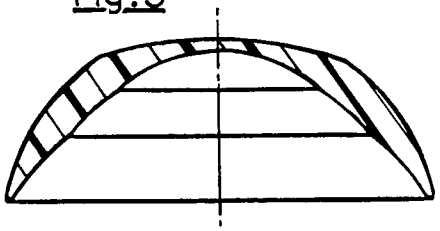

The lathe described herein is the first able to satisfy industrially the requirements of continuity of the spheric-anaspheric meridian profile of the concave back of the lens and also the first one which is able to carry out, still in one single cut, the continuous turning of the consecutive external spheric surfaces shown in FIG. 2 and FIG. 3. The design of a normal lathe for spherical surfaces and specifically of a machine for turning the spherical surfaces of a contact lens is extremely simple.

Figure 4:
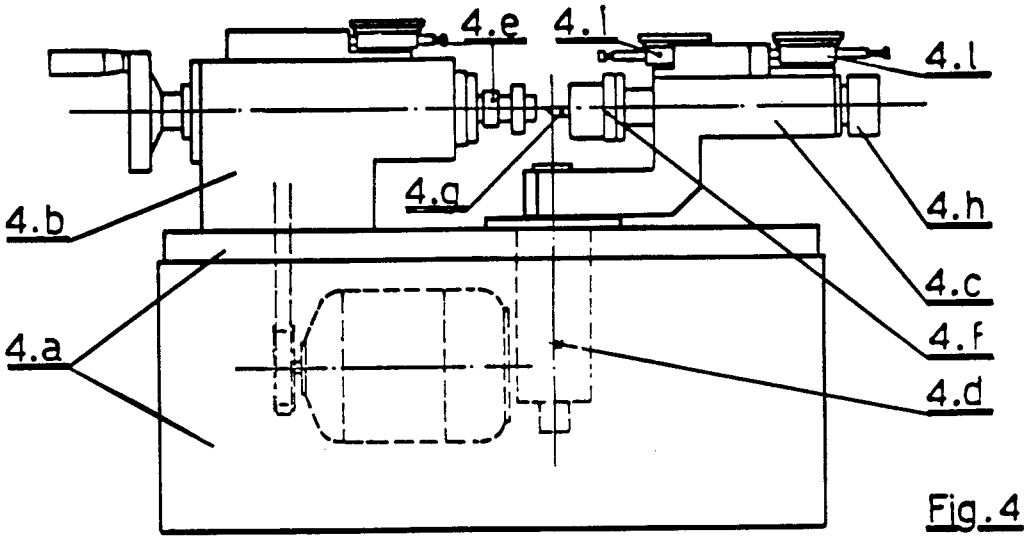
Figure 5:
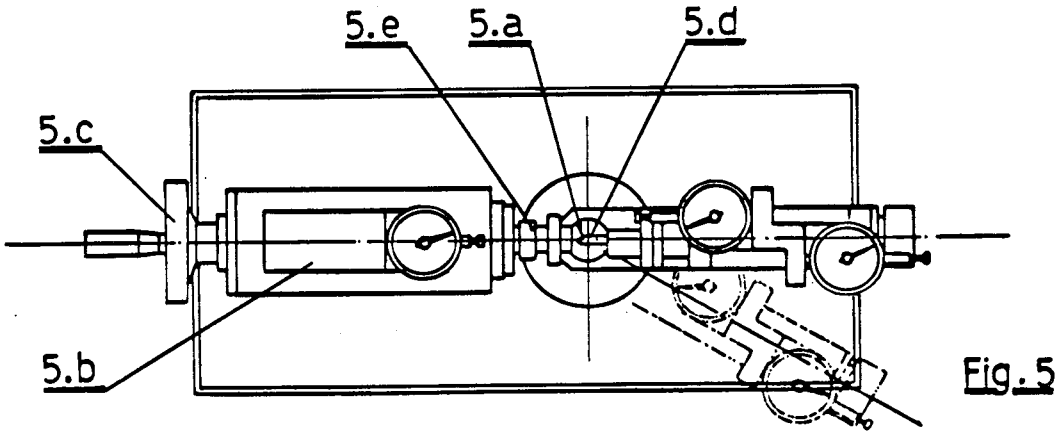

Referring to FIG. 4 which exemplifies, in elevation view, the simpler and more accurate among the numerous solutions available on the market, the machine is a facing lathe made up by the following basic components: the casing 4a; the motive head 4b; the tool turret 4c which looks like a horizontal lever arm pivoting upon the vertical shaft 4d.

Once the tool has skimmed the surface of the plastic blank to be spherically machined, a certain number of manual or electromechanical rotations of the turret are alternated with an equal number of forward translations of the lens holder's spindle, untill the spherical surface to be generated is entirely machined.

Although it may seem superfluous and referring to FIG. 4, it has been noticed that the distance of the tool's cutting point from the machined flat of the casing is always the same.

Figure 6:
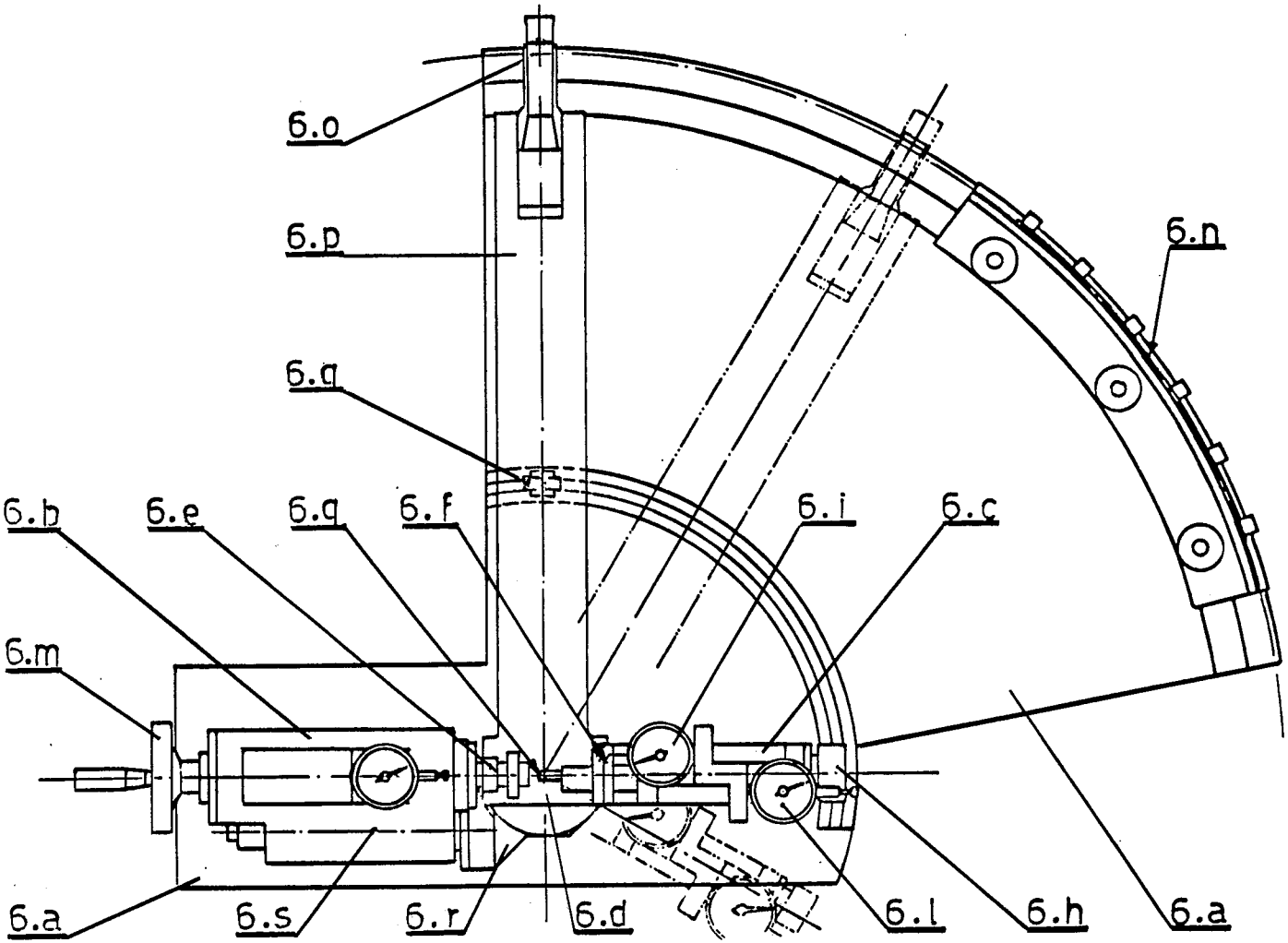

The new lathe according to the present invention, shown from above in FIG. 6 substantially imitates the design of the normal machine shown in FIGS. 4 and 5, as regards its motive head 6b, the tool's turret 6c, the lens holder's spindle 6e, the tool holder's rod 6f, the tool 6g, the threaded hand-wheel 6h, the dial indicators 6i and 6l, and the threaded hand-wheel 6m.

The lathe shown in FIG. 6 fundamentally differs from the normal machine according to FIGS. 4 and 5 as regards the structure of its casing 6a and in that there is no direct connection between the casing and the rotation axis 6d of the tool's turret.

Figure 7:
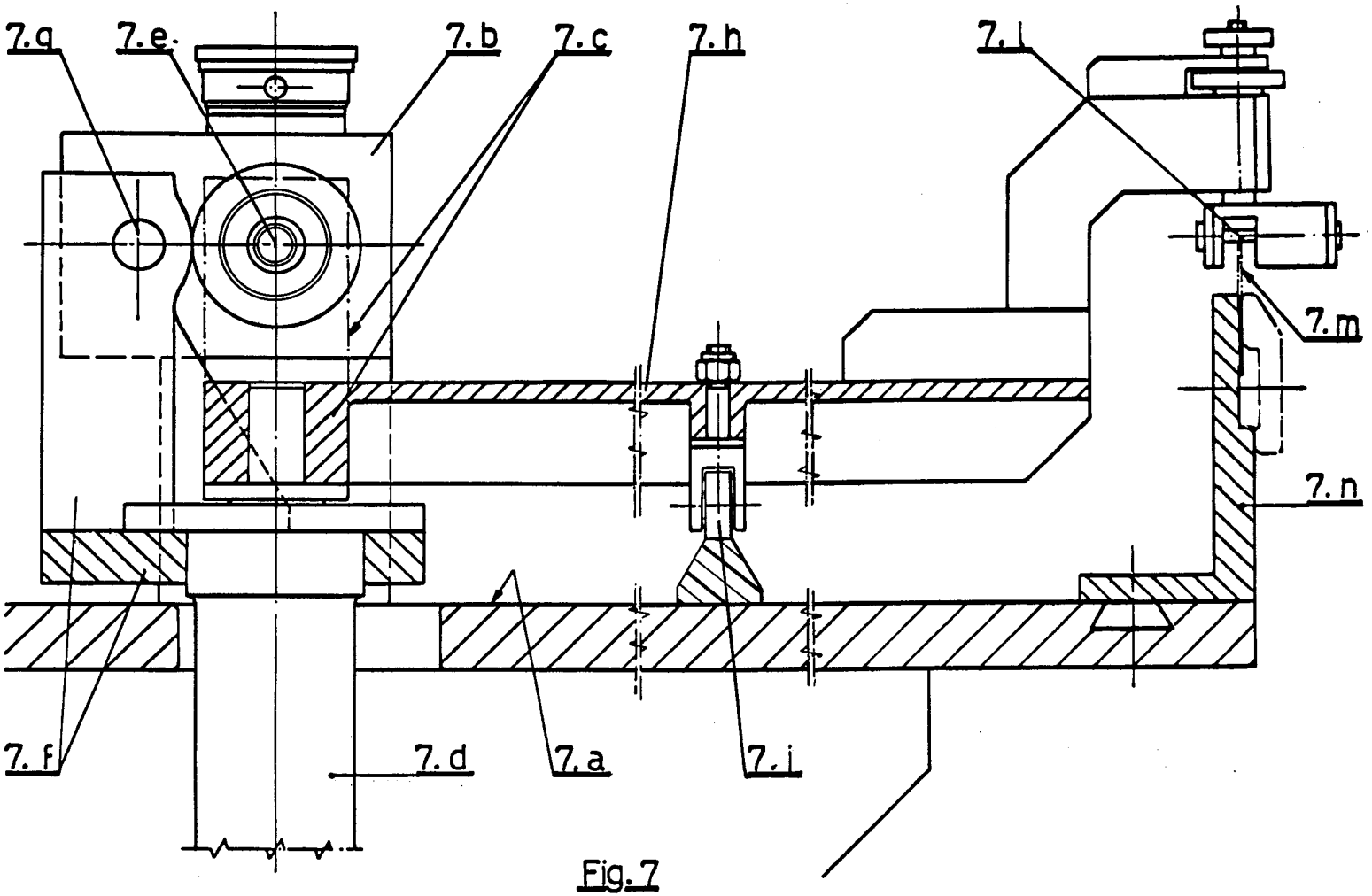

As clearly shown in FIG. 7 which represents in elevation view the motive head and the turret of the machine, the turret's vertical shaft 7d is really pivoted on the square support 7f which can swing around the horizontal shaft 7g pivoting, in its turn, on the motive head 7b, of the lathe, strictly parallel to the rotaition axis of the lens holder's spindle 7e. The distance between the spindle axis 7e and the horizontal axis 7g of the square support 7f must be the smallest, and it is preferrable that the two axes 7e and 7g are the same distance from the machined flat surface of the casing 7a on which leans the motive head 7b. From one side of the tool's turret 7c stretches out — for a calculated length — the lever arm 7h which is supporting the rollers 7i and 7l and which was called 6p in FIG. 6.

At a certain radial distance from the vertical axis 7d of the turret, the lever arm 7h is equipped with the roller bearing 7i which touches directly — or through the circular race — on the upper machined flat surface of the casing 7a on which is fixed the motive head 7b.

The touching roller 7i has been called 6g in FIG. 6. As long as, during the turret's rotation, there is a direct contact between the roller 7i and the circular race fixed on the machined flat surface of the casing 7a, the lathe of this invention — although more complicated than the normal lathe due to the presence of the square support 7f and the lever arm 7h together with its accessory parts — always generates only spherical surfaces similarly to the normal lathe according to FIGS. 4 and 5.

As a matter of fact, during the turret rotation, the tool's cutting point — initially coincident with the axis 7e — describes some arcs of circumference lying on a plane which is constantly parallel to and equidistant from the machined flat surface of the casing 7a. At the end of the lever arm 7h instead, is mounted the second small roller 7L which can come into contact — after a predetermined rotation angle of the turret 7c — with a circularly developed cam 7m which rises vertically from the machined flat surface of the casing 7a.

The cam 7m — supported in reality by the circular slide 7n which therefore allows the cam to assume all the required angular starting positions has a profile which is fundamentally climbing according to the geometrical law opposed by the anaspherical profile to be generated.

In FIG. 6 have been indicated by 6n the mentioned cam together with the circular slide which is supporting it and indicated by 6o the small roller which touches that cam. Therefore, once contact is made with the touching roller 6o after a prefixed rotation angle of the lever arm 6p and the turret 6c, the circular cam 6n causes first the lifting of the lever arm 6p, then the take-off on the roller 6q from the circular face fixed on the machined flat surface of the casing 6a, and finally the upward rotation of the square support 6r together with the turret, the tool holder's rod and the tool itself.

More clearly, it occurs that — as a consequence of the coming into contact of the roller 6o with the cam 6n the tool's cutting point, initially situated in coincidence with the axis 6l of the lens holder's spindle, stops to describe a prefixed circumference lying on the plane which is parallel to the machined flat surface of the casing 6a (that is on the drawing plane) and starts to describe instead a kind of rising irregular cylindrical helix which always obviously has the same preset radius of the tool's cutting point but it assumes some ordinates which are much lower than those of the cam, due to the fact that they are — demultiplied by the big ratio existing between the smallest distance of the roller 6o from the axis of the horizontal shaft 6s and the smallest distance of the tool's cutting point from the same horizontal axis.

Figure 8:
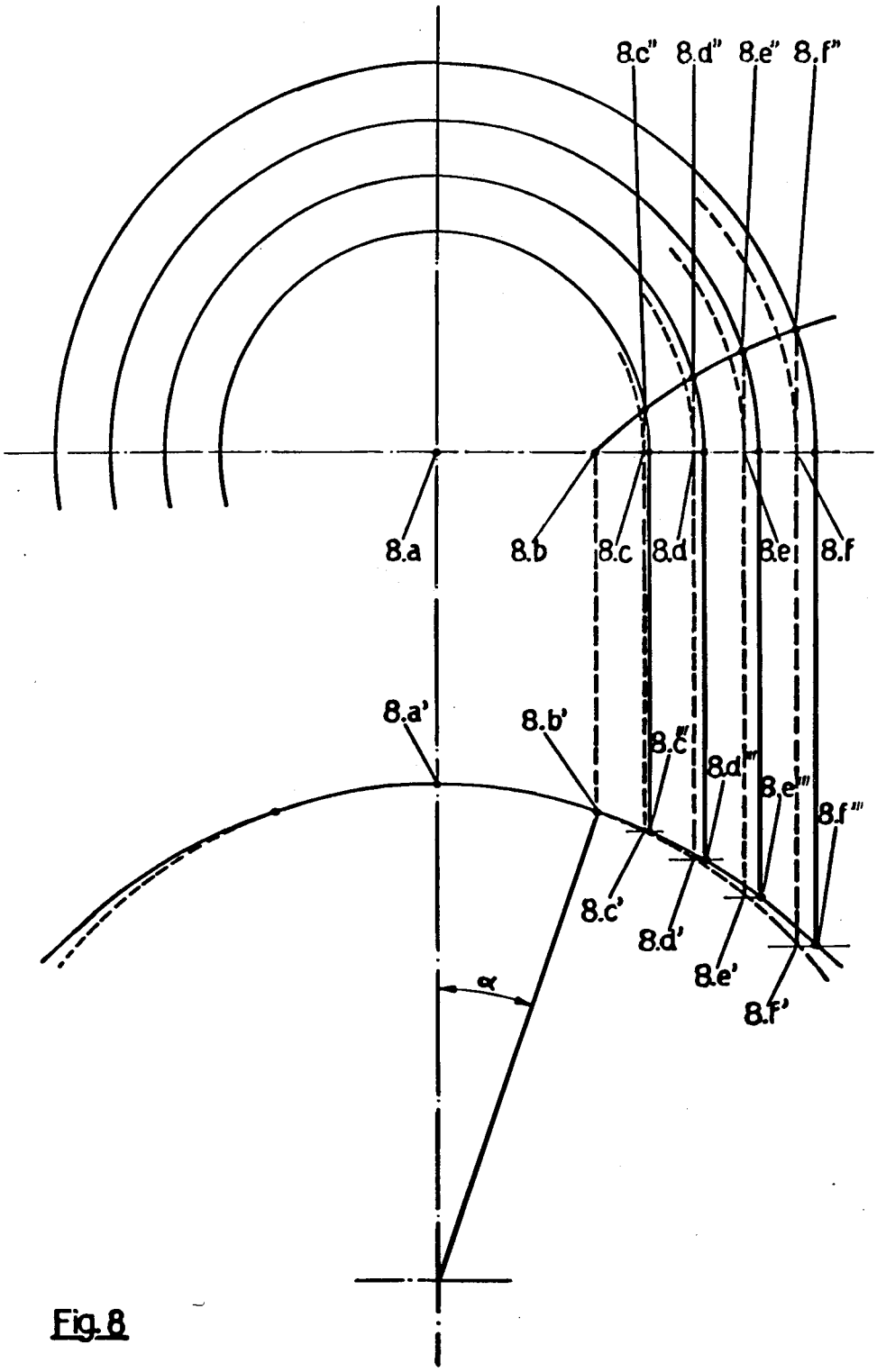

As will be better described in FIG. 8, it occurs that — always due to the lifting up of the tool caused by the cam 6n — the tool confers the coordinates of its cutting edge to a point of the generated surface which is situated above the horizontal meridian that the tool should have normally followed to generate a regular sphere (i.e. above the drawing plane), with the result of a deeper cutting of the tool's cutting edge into the material to be machined.

As this deeper cutting of the tool occurs, uninterruptedly — on all the len's peripheral circular crown involved by the cam 6n, it can be anticipated that — from the beginning of the cam's intervention — the meridian profile of the len's circular periphery is lacking in those characteristics of sphericity they are present instead in the central zone of the lens on which the cam has had no influence. FIG. 8 which only exemplifies the generation of a concave surface changing from spheric to anaspherical, clearly shows the geometrical situation which occurs from the beginning of the mentioned cam's intervention.

Points 8a, 8a' represent — in elevation view and planned view from above — the tool's cutting point situated in a position which is exactly in line with the axis of the len's holders spindle due to the rotation angle of the turret being equal to zero.

If the tool's cutting point has to generate a regular spherical surface, it will describe — in the view from above — the circular path delimitated e.g. by the two points 8a' and 8f', having as projection in the elevation view of the rectilinear segment delimitated e.g. by the two points 8a and 8f.

Such a circular path will thus coincide completely with the meridian profile of the obtained spherical surface. If the tool's cutting point — after an angular rotation $\alpha$ (alpha) from, 8a' to 8b' positions, shown in the view from above, i.e. after describing in the elevation view the rectilinear segment 8a - 8b is obliged instead to lift up along the trajectory passing through the points 8c'', 8d'', 8e'', 8f'', these points are not evident in the view from above by the points 8c', 8d', 8e', 8f', which are the projections of points 8c, 8d, 8e, 8f, belonging to the regular spherical surface, but — due to the fact that they are clearly situated on some circumferences having a bigger diameter in relation to those passing through the points 8c, 8d, 8e, 8f — they are then evident in the view from above by the points 8c'', 8d'', 8e'', 8f'' which determine a meridian profile that is anything but circular that is a revolution surface which is anything but spherical.

I claim:

1. A lathe for forming, in a single cut, successions of spherical and anaspherical surfaces that are either concave or convex and contiguous concave or convex spherical surfaces of different radii, said lathe including a tool holder turret having a rotatable vertical shaft that is not directly and rigidly supported by the base of the machine and a lens holder having a spindle, said lathe comprising a square support for hingedly mounting the tool holder turret on a horizontal face thereof, said square support being arranged to rotate about an axis that is perpendicular to a vertical face thereof, and therefore perpendicular to the rotational axis of the turret but not in the same plane thereof, the rotational axis of said square support being in a plane containing the axis of the lens holder spindle and parallel and spaced at the smallest distance other than zero from the axis of the lens holder spindle which axis is in a plane that is parallel to the horizontal rest plane of said lathe, a lever arm extending from the tool holder turret and perpendicular to the rotational axis thereof, first and second rollers supported by said lever arm, said first and second rollers having their axes perpendicular to the axis of rotation of the turret, said first roller being positioned at the end of said lever arm that is remote from the tool holder turret, said second roller being positioned intermediate said first roller and the axis of rotation of the turret and a circular cam having a rising profile on which said first roller rides.

2. The lathe according to claim 1 wherein said second roller engages a circular race lying in a plane which is parallel to the horizontal rest plane of the machine and is therefore parallel to the axis of the lens holder spindle, the vertical axis of said circular race being perpendiucular and convergent in relation to the axis of the spindle.

3. The lathe according to claim 2 wherein, during the time said second roller is in contact with said circular race, the cutting point of the tool mounted on the turret describes a circumference which lies in a plane which contains the axis of the lens holder spindle whereby the cutting point of the tool generates an exactly spherical revolution surface.

4. The lathe in accordinace with claim 2 wherein, when said first roller follows the rising profile of said cam, the cutting point of the tool describes an irregular cylindrical helix which allows either the generation of an anaspherical surface or the generation of a spherical surface that is characterized by a radius which differs from the radius of the spherical surface that the tool was generating before engaging said cam.

* * * * *